United States Patent [19]

Hering et al.

[11] 3,943,873

[45] Mar. 16, 1976

[54] CARGO/BALLAST SEPARATION BY DUAL MEMBRANE SYSTEM

[75] Inventors: Frederic S. Hering, Chesapeake, Va.; Joseph I. Schwartz, Ellicott City, Md.

[73] Assignee: The United States of America as represented by the Secretary of the Navy, Washington, D.C.

[22] Filed: Mar. 18, 1974

[21] Appl. No.: 452,082

[52] U.S. Cl. ..... 114/125; 114/74 R; 220/22

[51] Int. Cl.[2] ..... B63B 25/12

[58] Field of Search ..... 114/74 R, 74 A, 74 T, 121, 114/125, .5 T, 16 E; 220/85 B, 22; 222/214

[56] References Cited

UNITED STATES PATENTS

| | | | |
|---|---|---|---|
| 2,696,185 | 12/1954 | Snoddy | 114/74 R |
| 3,085,533 | 4/1963 | Goryl et al. | 114/74 T |
| 3,477,401 | 11/1969 | Hayama | 114/74 A |
| 3,499,410 | 3/1970 | Field et·al. | 114/74 R |
| 3,707,937 | 1/1973 | Liles | 114/74 R |

*Primary Examiner*—Trygve M. Blix
*Assistant Examiner*—Charles E. Frankfort
*Attorney, Agent, or Firm*—R. S. Sciascia; Q. E. Hodges

[57] ABSTRACT

A ballasting system for oil tankers and other ships for separating the oil and the water ballast which eliminates oil contamination and pollution in ballasting and deballasting ships. Flexible fabric-reinforced or stretchable membranes are attached in liquid sealing relationship within the oil tank all around at the athwartships quarter-points to thereby preclude flow between the oil and ballast water. Ballast water is contained in the tank on one side of the membranes while the oil cargo or the flowable cargo is separated on the other side of the membranes. The entire tank can be maintained full for ship stability and prevention of sloshing of the fluids.

3 Claims, 3 Drawing Figures

CARGO/BALLAST SEPARATION BY DUAL MEMBRANE SYSTEM

The invention described herein may be manufactured and used by or for the Government of the United States of America for governmental purposes without the payment of any royalties thereon or therefore.

BACKGROUND OF THE INVENTION

The instant invention relates generally to ship ballasting systems and more particularly to a ballasting system using membranes that separate the oil and the water ballast therefore eliminates oil contamination and water pollution.

It is well known in the art of ships and particularly oil tankers that the ship rides dangerously high in the water when its fuel tanks, oil cargo tanks, or cargo holds are empty. The ship lacks roll stability, is subject to severe bending stresses in hog and sag, steerage is difficult, and the ride gives discomfort to the crew. For these reasons, it is common practice to "ballast" the ship by filling the tanks and holds with seawater when they are empty or even when partially empty of oil. Further, it is the practice to pump in ballasting water to facilitate the pumping out of the oil cargo from oil tankers.

Heretofore, there have been no attempts made to positively separate the oil and the water ballast because they are considered substantially immiscible and have different specific gravities with oil being the lighter and therefore always floating on top of the water. However, it is possible for the oil and water to emulsify particularly at the interface due to churning during pumping or sloshing during transit. For this reason, when offloading a cargo of oil, some water is carried over to contaminate the delivered oil. Also, moisture-laden air vented into the tank causes water build-up. Furthermore, a particular problem exists when the tanker takes on a load of oil and deballasts at the same time in that a significant amount of oil goes overboard entrained with the ballast water to contaminate and pollute the area. This oil eventually finds its way to local beaches making them unfit for use and kills much wildlife.

Another problem associated with the state-of-the-art ballasting method is that it contributes greatly to repair costs of the ship because the seawater causes corrosion in the tanks. Periodically, the tanks must be drained, steam cleaned, scaled, and repainted. If the tanker has been carrying gasoline or other highly flammable products, this repair is extremely dangerous. It is also obvious that this old ballasting method is wasteful of the contaminated portion of oil, be it crude oil, heating oil, jet fuel, or gasoline cargo or fuel for the ship's propulsion.

SUMMARY OF THE INVENTION

Accordingly, an object of the present invention is to provide a new and improved ballasting system for oil cargo ships and other ballasting ships.

Another object of the instant invention is to provide a ballasting system that reduces the waste of oil and the necessity of frequent repair.

Still another object of the present invention is to provide a ballasting system for ships which eliminates contamination of the oil cargo and pollution of the seas, harbors, and beaches.

A further object of the instant invention is to provide a ballasting system for ships which completely separates the oil cargo and water ballast, yet functions like the conventional ballasting system.

Briefly, these and other objects of the present invention are attained by the use of a pair of fabric reinforced flexible membranes attached in liquid sealing relationship within, and dividing an oil tank into separate sections. The membranes are loosely draped and secured at their edges at the athwartships quarter points of the tank, that is, at distances of one-quarter, and three-quarters across the width of the tank to the overhead structure, the fore and aft bulkheads or walls, and the bottom. For convenience, the invention will be discussed with regard to an oil tanker ship and the assumption that the ballasting water is contained between the pair of membranes near the center of the tank while the oil cargo is contained in the separate outer portions of the tank, completely separated from the water. The membranes are loosely draped and can readily move back and forth as the oil or water replace and displace each other in ballasting or de-ballasting operations.

BRIEF DESCRIPTION OF THE DRAWINGS

A more complete understanding of the invention and many of the attendant advantages thereof will be readily appreciated as the same become better understood by reference to the following detailed description when considered in connection with the accompanying drawings wherein.

DESCRIPTION OF THE PREFERRED EMBODIMENT

Figure 1:
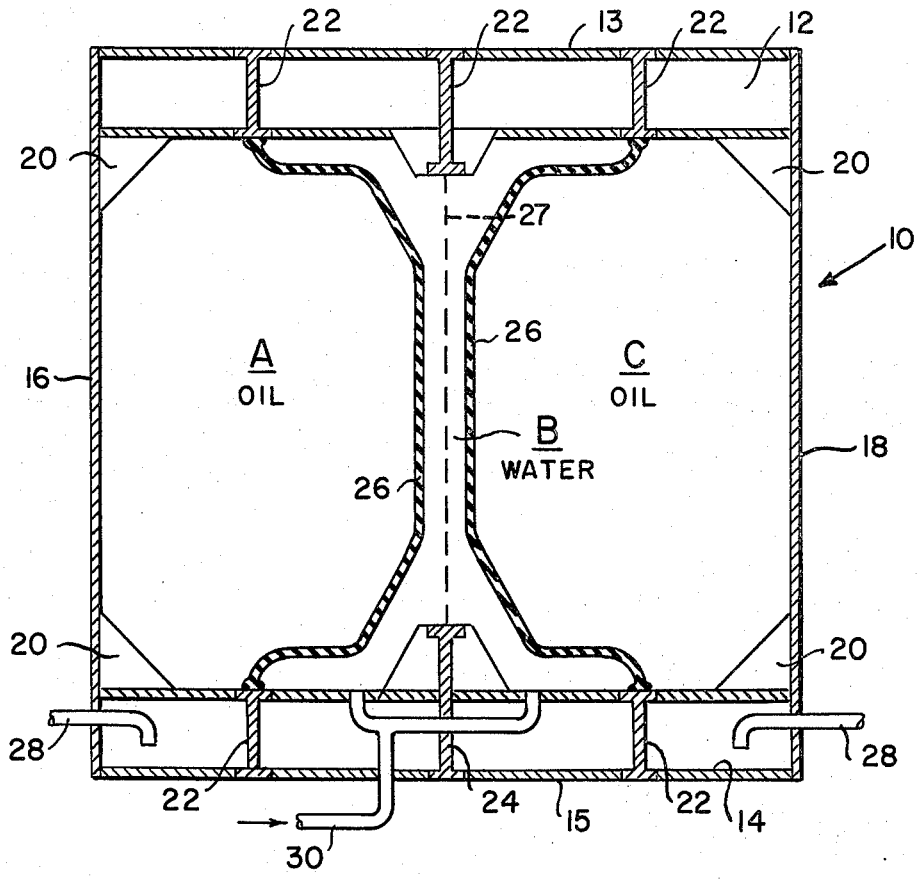
FIG. 1 is a schematic transverse cross-section view of a tank in an oil tanker with 100% cargo.

Referring now to the drawings wherein like reference numerals designate corresponding parts throughout the several views, there is shown generally in FIG. 1 an oil cargo tank 10, formed in an oil tanker, having an upper transverse flanged web 12 supporting a deck 13 and a lower transverse flanged web 14 welded to the hull 15, both having an I or T beam cross-section. Each of the transverse webs shown are terminated at the sides with a port bulkhead 16 and a starboard bulkhead 18. Reinforcing angles 20 further strengthen the attachment to the bulkheads 16 and 18. A plurality of longitudinal frame members 22, and a keel 24 running the length of the ship and also having an I or T beam cross-section are welded to the transverse webs 12 and 14 to form the ship's structural frame and incidentally the tank 10. Since the transverse webs 12 & 14 are either I or T shaped, the floor and deck of the tank may be attached at either the top or bottom of the webs. However, as indicated the deck 13 is attached to the tops of the webs 12 while the bottom of the tank is split between the top and bottom of the webs 14 as shown.

Within the tank 10, according to the instant invention, are a pair of flexible membranes 26, made of cloth or fiber reinforced rubber, neoprene, polyethylene, or the like. Each membrane 26 is loosely draped in the tank and secured in liquid sealing relationship as with screw fasteners and clamping plates, or the like, at its edges along the fore and aft length of an overhead longitudinal 22, the forward bulkhead, a floor longitudinal 22, and the after bulkhead at the athwartships quarter-points of the tank 10 as shown in FIG. 1. Thus, the tank is divided into three sections A, B, and C across it's width these sections are watertight from each other. A lightweight perforated bulkhead 27 is installed between the membranes 26 to avoid abrasion and overstressing of the membranes.

Near the bottom of the tank 10, between the transverse flanged webs 14, and fluidly communicating with the oil cargo sections A and C are oil cargo piping connections 28 for drawing off the oil. Fluidly communicating with the ballast section B at the bottom of the tank 10 is a ballast piping connection 30, which may be bifurcated for ease of flow of the seawater ballast in and out of the section B and avoid interference with the keel or other frame structure if no limbers are provided in the keel 24, and transverse 12 and 14 webs.

Figure 2A:
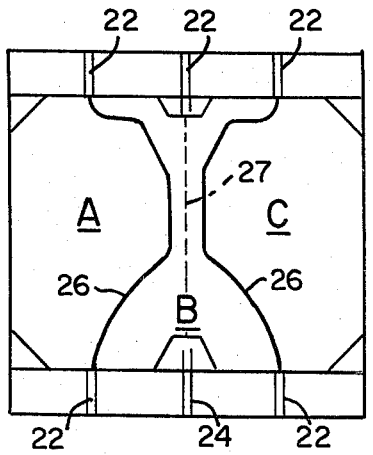
FIGS. 2*a* and 2*b* are schematic transverse cross-sectional views of an oil tank with other percentages of cargo.
Figure 2B:
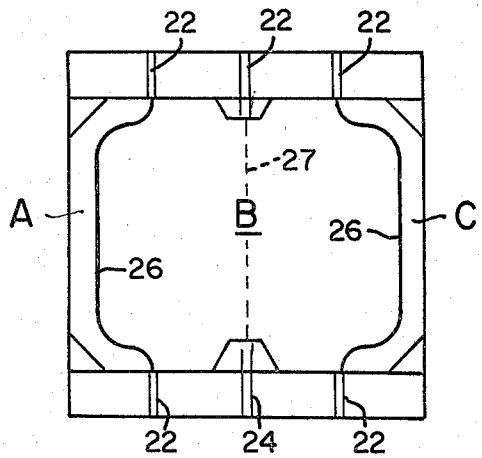

In operation, in addition to FIG. 1, reference may be made to FIG. 2a and 2b wherein the tank 10 is shown in various filling conditions. As was discussed hereinbefore, it is desirable for ship stability to keep the tank 10 filled with oil cargo or seawater ballast. Therefore, as oil is pumped out of the tank sections A and C through the oil cargo connections 28, seawater ballast enters the tank section B through the ballast connection 30. This operation may continue from a full oil tank as shown in FIG. 1, to the intermediate condition shown in FIG. 2*a*, and thence to where substantially all the oil has been pumped out as is shown in FIG. 2*b*. It is evident from a view of the Figures, that seawater ballast has replaced in tank section B, the volume vacated by oil in tank section A and C, and that the loosely draped membranes 26 have separated and expanded into section A and C commencing at the bottom due to the higher specific gravity of the water. It is to be particularly noted that the membranes have at all times maintained the separation of the oil from the seawater precluding contamination of the oil. It is to be understood that this operation works equally well with a self-ballasting system, where ballasting water is pumped in and forces the oil cargo out at positive pressure, as well as the standard system, discussed above, where ballasting water is pumped in as from the fire main system or allowed to flow in as the oil is pumped out under negative pressure.

When the oil tanker is about to be loaded, the tank 10 is usually ballasted in tank section B with the membranes 26 expanded into sections A and C as shown in FIG. 2*b*. As the sections A and C fill with oil, the membranes 26 begin converging at the top as shown in FIG. 2*a*, forcing out the ballasting water from tank section B through the ballast connection 30 to an overboard drain in the ship's hull. Due to the complete separation of the oil from the ballasting water by the membranes 26, the de-ballasted water is oil-free and will not pollute the water where the ship is floating.

Obviously, many modifications and variations of the present invention are possible in light of the above teachings. For example, this novel ballasting system can be used on any ship to ballast its fuel tanks and also has the advantage that the ballasting section B between the membranes is kept relatively clean and is smooth-walled, and readily could be used for carrying other cargo such as dry powders, grains, pellets and slurries, etc. It is therefore to be understood that within the scope of the appended claims, the invention may be practiced otherwise than as specifically described.

What is claimed is:

1. A ship ballasting system separating the oil cargo and the water ballast sections comprising:

a substantially closed oil tank having an overhead structure, bulkheads, and a bottom;

a liquid cargo connection communicating with the oil cargo sections of said tank;

a ballast connection communicating with the ballast sections of said tank; and a pair of flexible membranes attached in sealing relationship to said overhead structure, bulkheads, and bottom of said tank at the quarter-points thereby separating said oil tank into cargo sections and a ballast section; and a lightweight perforated bulkhead attached at said overhead structure, bulkheads, and floor at the vertical centerline of said oil tank between said pair of flexible membranes.

2. The ship ballasting system of claim 1 wherein said flexible membranes are made of a fiber reinforced liquid impervious material.

3. The ship ballasting system of claim 1 wherein said flexible membranes are made of a stretchable liquid impervious material.

* * * * *